US008138382B2

(12) United States Patent
Kanda et al.

(10) Patent No.: US 8,138,382 B2
(45) Date of Patent: Mar. 20, 2012

(54) PROCESS FOR PRODUCING MIXED GAS HYDRATE

(75) Inventors: Nobuyasu Kanda, Ichihara (JP); Masahiro Takahashi, Ichihara (JP); Toru Iwasaki, Ichihara (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 245 days.

(21) Appl. No.: 12/449,435

(22) PCT Filed: Mar. 28, 2008

(86) PCT No.: PCT/JP2008/056243

§ 371 (c)(1),
(2), (4) Date: Aug. 7, 2009

(87) PCT Pub. No.: WO2008/120767

PCT Pub. Date: Oct. 9, 2008

(65) Prior Publication Data

US 2011/0015455 A1 Jan. 20, 2011

(30) Foreign Application Priority Data

Mar. 30, 2007 (JP) ..... 2007-093948

(51) Int. Cl.
*C07C 9/04* (2006.01)

(52) U.S. Cl. ..... 585/15; 62/45.1

(58) Field of Classification Search ..... 585/15
See application file for complete search history.

(56) References Cited

U.S. PATENT DOCUMENTS 5,536,893 A * 7/1996 Gudmundsson ..... 585/15
7,914,749 B2 * 3/2011 Carstens et al. ..... 422/198

FOREIGN PATENT DOCUMENTS

| | | |
|---|---|---|
| JP | 2002-038171 | 2/2002 |
| JP | 2003-064385 | 3/2003 |
| JP | 2005-206685 | 8/2005 |
| JP | 2005-320454 | 11/2005 |
| JP | 2006-104256 | 4/2006 |

* cited by examiner

*Primary Examiner* — Ellen McAvoy
(74) *Attorney, Agent, or Firm* — Jacobson Holman PLLC

(57) ABSTRACT

The composition of raw mixed gas and the gas composition of produced mixed gas hydrate are uniformed as rapidly as possible. The process for producing a mixed gas hydrate comprises the gas hydrate forming step of reacting a mixed gas (g) with water (w) to thereby obtain a gas hydrate in slurry form; the dewatering step of removing the water (w) from the gas hydrate slurry (s); the palletizing step of forming the gas hydrate after water removal into pellets; the freezing step of chilling the gas hydrate pellets (p) to the freezing point or below to thereby freeze the same; and the pressure reduction step of depressurizing the frozen gas hydrate to storage pressure, wherein the mixed gas (g) fed to the gas hydrate forming step is diluted by diluent gas (m) as a constituent of the principal components of the mixed gas (g).

4 Claims, 5 Drawing Sheets

PROCESS FOR PRODUCING MIXED GAS HYDRATE

TECHNICAL FIELD

This is a national stage of PCT/JP08/056243 filed Mar. 28, 2008 and published in Japanese, which has a priority of Japanese no. 2007-093948 filed Mar. 30, 2007, hereby incorporated by reference.

The present invention relates to a method for producing mixed gas hydrate to produce a hydrate of mixed gas.

BACKGROUND ART

Natural gas is one of mixed gases, containing methane as a constituent of the principal composition thereof. Natural gas has a composition of, for example, 86.73% of methane, 8.86% of ethane, 3.47% of propane, 0.41% of i-butane, 0.52% of n-butane, and 0.01% of nitrogen.

The condition for forming a gas hydrate differs depending on the kind of gas. Generally, gases having larger molecular weight tend to give a hydrate equilibrium condition of lower pressure and higher temperature. Accordingly, gases having larger molecular weight, such as ethane and propane, easily form gas hydrate than methane having smaller molecular weight. In the case of natural gas, therefore, heavier components such as ethane and propane tend to form gas hydrate first, while methane is left behind in the gas phase in large amounts.

Conventionally, in the gas hydrate formation section, a portion of non-reacted gas in the gas hydrate formation system is once carried out therefrom, and then is returned to the system to circulate thereof, which thus increases the formation efficiency of the gas hydrate. The method, however, has a limitation in increasing the efficiency.

According to the above method of the prior art, the gas hydrate formed in the gas hydrate formation section is sent to a cooling section to freeze the gas hydrate by chilling to at or below the freezing point thereof, and the frozen gas hydrate is depressurized in the depressurizing section to a storage pressure, and then the depressurized gas hydrate is sent to the storage section. During the transfer of the depressurized gas hydrate, the non-reacted methane-rich gas which is sent, accompanied with the gas hydrate, from the gas hydrate formation section to the cooling section is further accompanied with the gas hydrate, in the stage of depressurizing to the storage pressure, to enter the storage section. In the prior art, the methane-rich non-reacted gas which is depressurized to the storage pressure near atmospheric pressure is utilized as a fuel outside the system, or is recycled to the raw material system for eliminating loss.

Although gas hydrate is said to have self-retaining properties, the gas hydrate once formed by depressurizing in the pressure-reducing section is decomposed in a part, in some cases. The gas components generated by the decomposition also reach said storage section, and are treated in a similar way.

As a result, in the conventional production method, there were problems that a part of the natural gas as a raw material became a methane-rich gas so as to require different handling, and that the composition of raw material natural gas differs from that of the gas in produced natural gas hydrate.

Since different gas composition gives different calorific value and combustion rate, the gas composition is required to be adjusted so that the gas composition caused by gasification of hydrate and the raw material gas composition become equivalent, which results in increasing the cost.

In order to make the composition of the raw material natural gas and the gas composition of the produced natural gas hydrate equal with each other, there has been proposed a method for producing natural gas hydrate having the steps of: forming a gas hydrate through a reaction between natural gas and water under a low temperature and high pressure condition within the zone where hydrate is formed; freezing the formed gas hydrate by chilling to below the freezing point thereof; and depressurizing the frozen gas hydrate to a storage temperature, wherein the gas components existed after said step of depressurizing is pressurized to return the gas components to said step of forming gas hydrate, (for example, refer to Patent Document 1).

The invention disclosed in Patent Document 1, however, as described above, requires extra pressure-increasing utilities which recycle the methane-rich non-reacted gas conventionally released outside the system to the step of forming gas hydrate. Although the methane-rich non-reacted gas does not go to waste, a long time (for example, 2 to 24 hours) is required until the composition of the raw material natural gas becomes equal to the gas composition of produced natural gas hydrate.

Since the invention disclosed in Patent Document 1 adopts the second formation apparatus at the downstream side of the first formation apparatus, extra utility cost for pressure increase is required. In addition, there are problems of the increase in the building height, and the like.

Patent Document 1: Japanese patent application Kokai publication No. 2005-320454

DISCLOSURE OF THE INVENTION

Problems to be Solved by the Invention

The present invention has been perfected to solve the above problems, and an object of the present invention is to provide a method for producing mixed gas hydrate, by which method the composition of raw material mixed gas and the gas composition of the produced mixed gas hydrate can become equivalent as rapidly as possible. Another object of the present invention is to provide a method for producing mixed gas hydrate, which method can reduce the conventional ancillary facilities such as pressure-increasing utilities to suppress the increase in the utility cost.

Means to Solve the Problems

The method for producing mixed gas hydrate relating to the invention of claim 1 is one for producing mixed gas hydrate comprising the steps of: forming a gas hydrate in slurry form by the reaction between a mixed gas and water; removing water from the gas hydrate in slurry form; pelletizing the gas hydrate after removing water therefrom to form pellets; freezing the gas hydrate in pellet form by chilling to at or below the freezing point thereof; and depressurizing the frozen gas hydrate to a storage pressure, wherein the mixed gas to be supplied to said step of forming the gas hydrate is diluted by a diluent gas as a constituent of the principal composition of the mixed gas, and thus the mixed gas hydrate is produced by the diluted mixed gas.

The method for producing mixed gas hydrate relating to the invention of claim 2 is one for producing mixed gas hydrate comprising the steps of: forming a gas hydrate in slurry form by the reaction between a mixed gas and water; removing water from the gas hydrate in slurry form; pelletizing the gas hydrate after removing water therefrom to form pellets; freezing the gas hydrate in pellet shape by chilling to at or below the freezing point thereof; and depressurizing the frozen gas hydrate to a storage pressure, wherein a diluent gas as the constituent of the principal composition of said mixed gas is preliminarily charged to said step of forming the gas hydrate, said step of removing water, said step of palletizing the gas hydrate, and said step of freezing the gas hydrate.

The method for producing mixed gas hydrate relating to the invention of claim 3 is the one for producing mixed gas hydrate according to claim 1 or claim 2, wherein the supply of the diluent gas is stopped 0 to 6 hours after the start of the formation of the gas hydrate.

EFFECT OF THE INVENTION

As described above, the invention relating to claim 1 is a method for producing mixed gas hydrate comprising the steps of: forming a gas hydrate in slurry form by the reaction between a mixed gas and water; removing water from the gas hydrate in slurry form; pelletizing the gas hydrate after removing water therefrom to form pellets; freezing the gas hydrate in pellet shape by chilling to at or below the freezing point thereof; and depressurizing the frozen gas hydrate to a storage pressure, wherein the mixed gas to be supplied to said step of forming the gas hydrate is diluted by a diluent gas as a constituent of the principal composition of the mixed gas, and thus the mixed gas hydrate is produced by the diluted mixed gas. Consequently, the period during which the composition of raw material mixed gas and the gas composition of the produced mixed gas hydrate become equal can be significantly shortened. In addition, according to the present invention, only one hydrate-forming apparatus is required, and thus the height of the building can be suppressed.

As described above, the invention relating to claim 2 is a method for producing mixed gas hydrate comprising the steps of: forming a gas hydrate in slurry form by the reaction between a mixed gas and water; removing water from the gas hydrate in slurry form; pelletizing the gas hydrate after removing water therefrom to form pellets; freezing the gas hydrate in pellet shape by chilling to at or below the freezing point thereof; and depressurizing the frozen gas hydrate to a storage pressure, wherein the diluent gas as a constituent of the principal composition of said mixed gas is preliminarily charged to said step of forming the gas hydrate, said step of removing water, said step of forming pellets, and said step of freezing the gas hydrate. Consequently, compared with the invention relating to claim 1, the control of diluent gas becomes easy. Furthermore, the period during which the composition of raw material mixed gas and the gas composition of the produced mixed gas hydrate become equivalent can be significantly shortened than ever before. In addition, according to the present invention, only one hydrate-forming apparatus is required, and thus the height of the building can be suppressed.

Figure 1:
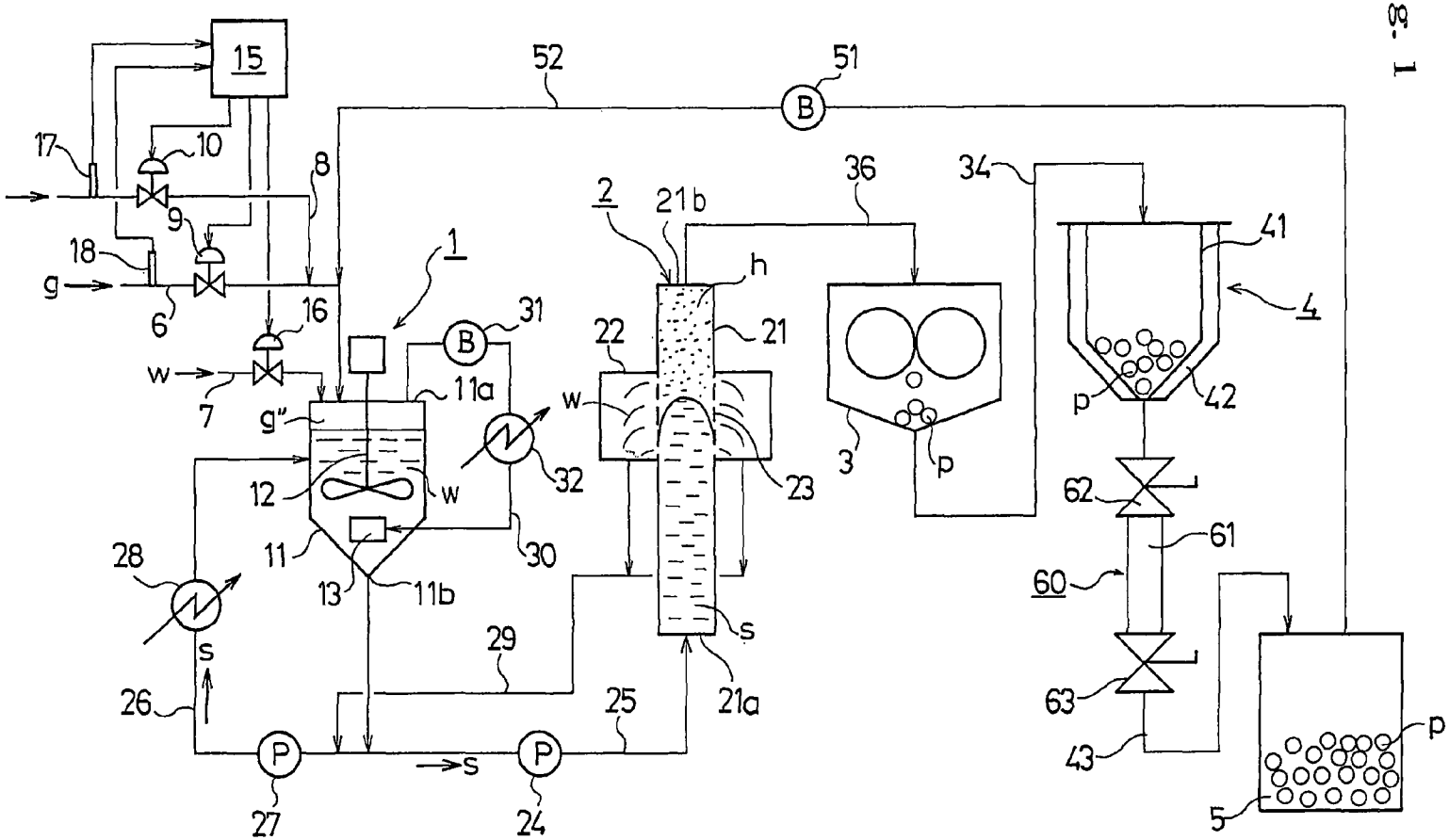
FIG. 1 shows rough structure of the first production facilities which conduct the method for producing mixed gas hydrate according to the present invention.

DESCRIPTION OF REFERENCE SYMBOLS g mixed gas
m diluent gas
p gas hydrate pellet
s gas hydrate slurry
w water

BEST MODE FOR CARRYING OUT THE INVENTION

The embodiments of the present invention will be described below referring to the drawings.

(A) First Embodiment

The description will begin with the first embodiment of the mixed gas hydrate production facilities to conduct the method for producing mixed gas hydrate according to the present invention, and then the description will be given to the second embodiment.

As illustrated in FIG. 1, the mixed gas hydrate production facilities are structured mainly by a gas hydrate-forming apparatus 1, a dewatering tower 2, a high-pressure pelletizer 3, a pellet cooler 4, and a pellet storage tank 5.

The gas hydrate-forming apparatus 1 has an agitator 12 and a gas ejection nozzle 13 in a vessel 11. The vessel 11 has a mixed gas supply pipe 6 and a raw material water supply pipe 7 at the top part 11*a* thereof and connects a diluent gas supply pipe 8 with the mixed gas supply pipe 6. A controller 15 controls a flow-regulating valve 9 positioned in the mixed gas supply pipe 6 and a flow-regulating valve 10 positioned in the diluent gas supply pipe 8, and thus dilutes the mixed gas g (for example, natural gas) by the gas m (for example, methane) as the constituent of the principal composition of the mixed gas g (natural gas).

The controller 15 conducts ON-OFF control of a valve 16 positioned in the raw material water supply pipe 7. The mixed gas supply pipe 6 and the diluent gas supply pipe 8 are provided with gas flow meters 17 and 18, respectively, and thus the flow rates of the mixed gas and of the diluent gas are entered to the controller 15. The flow-regulating valve 10 in the diluent gas supply pipe 8 automatically closes after a predetermined period (for example, 0 to 6 hours) has passed from the start of hydrate production.

The dilution rate by the diluent gas differs depending on the composition of the mixed gas, and a preferable dilution rate is, for example, within the range of about 21 to 32%, more preferably about 23 to 30%. The dilution rate corresponding to the composition of the mixed gas can be determined by a theoretical calculation, (for example, refer to a hydrate equilibrium calculation program CSMHYD, (E. D. Sloan Jr. Clathrate Hydrates of Natural Gases, Marcel Dekker, Inc., N.Y. (1998)).

The dewatering tower 2 is structured by a vertical cylindrical tower body 21, a hollow water-discharging part 22 positioned outside the tower body 21, and a screen 23 positioned on a part of the tower body facing the water-discharging part 22. The bottom part 21*a* of the tower body 21 is communicated with the bottom part 11*b* of the vessel 11 of the gas hydrate-forming apparatus by a slurry supply pipe 25 equipped with a slurry pump 24. A slurry circulation passage 26 branched from the slurry supply pipe 25 is connected to the side surface of the vessel 11 of the gas hydrate-forming apparatus. The slurry circulation passage 26 has a second slurry pump 27 and a second cooler 28, and thus the natural gas hydrate slurry s in the slurry circulation passage 26 is cooled to a specified temperature. The water-discharging part 22 of the dewatering tower 2 and the slurry circulation passage 26 are communicated with each other by a water discharge pipe 29.

The gas hydrate-forming apparatus 1 has a gas circulation passage 30 which communicates with the top part 11*a* of the vessel 11 and with the gas ejection nozzle 13 in the vessel 11, through which the non-reacted gas g" accumulated at the upper part of the vessel 11 is supplied to the gas ejection nozzle 13 by a blower 31. On this occasion, the non-reacted gas g" is cooled to a specified temperature by a cooler 32.

As the high-pressure pelletizer 3, for example, a high-pressure pelletizer using a briquetting roll is applied so as to form pellets p in a specified shape (such as lens shape, almond shape, and pillow shape).

The pellet cooler 4 is made of a hollow vessel 41. By using a cooling jacket 42 positioned at the outer side of the vessel 41, the pellets p in the vessel 41 are cooled to a specified temperature (for example, approximately within the range of about −15° C. to −30° C.). In the middle of a duct 43 which communicates the pellet cooler 4 with the pellet storage tank 5, there is a depressurizing apparatus 60. The depressurizing apparatus 60 is structured by a cylindrical vessel 61, a valve 62 at the top of the cylindrical vessel 61, and a valve 63 at the bottom of the cylindrical vessel 61.

The pellet storage tank 5 is connected to the mixed gas supply pipe 6 via a non-reacted gas recycle pipe 52 equipped with a second blower 51. The high-pressure pelletizer 3 and the pellet cooler 4 are connected with each other by a pellet discharge duct 34. The dewatering tower 2 and the high-pressure pelletizer 3 are connected with each other by a hydrate supply duct 36.

Next, the description about the working state of the mixed gas hydrate production facilities will be given.

While agitating the raw material water w (hereinafter referred to as the "water"), supplied to the vessel 11 of the gas hydrate-forming apparatus 1, by the agitator 12, the natural gas g (mixed gas) under a specified pressure (for example, about 5 MPa) is supplied from the mixed gas supply pipe 6, and further methane (diluent gas) m, as the constituent of the principal composition of the natural gas g under a specified pressure (for example, about 5 MPa) is supplied through the diluent gas supply pipe 8. On this occasion, the controller 15 adjusts the flow-regulating valves 9 and 10 to dilute the natural gas g to a specified concentration (for example, about 3 to about 30%) by the methane m.

The non-reacted gas g" in the gas hydrate-forming apparatus 1 is supplied to the gas ejection nozzle 13 by the blower 31, and the non-reacted gas g" becomes fine bubbles to thereby be injected into the water w. The non-reacted gas g" and the water win the vessel 11 conduct the hydration reaction to form the natural gas hydrate. On this occasion, the second slurry pump 27 and the second cooler 28 are operated and the natural gas hydrate slurry s in the circulation route is cooled to a specified temperature (for example, about 3° C.)

The natural gas hydrate slurry in the vessel 11 of the gas hydrate-forming apparatus 1 is supplied to the bottom part 21*a* of the dewatering tower 2 by the slurry pump 24. While the natural gas hydrate slurry s supplied to the dewatering tower 2 ascends along the tower body 21, the water w is removed through the screen 23. After removing excess water, the natural gas hydrate h having the water content ranging from about 30 to 50% by weight is supplied from the top part 21*b* of the dewatering tower 2 to the high-pressure pelletizer 3, where the natural gas hydrate h is formed into pellets p.

The pellets p are supplied to the pellet cooler 4, where the pellets p are cooled to a specified temperature (for example, within the range of about −15° C. to 30° C.) . The pellets p cooled in the pellet cooler 4 are depressurized by the depressurizing apparatus 60 to a storage pressure (for example, atmospheric pressure), which are then supplied to the pellet storage tank 5 to store therein. The non-reacted gas in the pellet storage tank 5 is returned to the mixed gas supply pipe 6 via the non-reacted gas recycle pipe 52.

After a specified time (for example, 0 to 6 hours) has passed from the start of the formation of hydrate, the flow-regulating valve 10 of the diluent gas supply pipe 8 automatically closes. Thus, the pellet storage tank 5 is exchanged to a new one, and the pellets immediately after beginning the gas hydrate formation are discarded, or are gasified for reuse.

(B) Second Embodiment

Next, the description will be given to the second embodiment of the mixed gas hydrate production facilities according to the present invention. The same equipment as that in the first embodiment has the same reference number thereto, and the detail description thereof is omitted.

Figure 2:
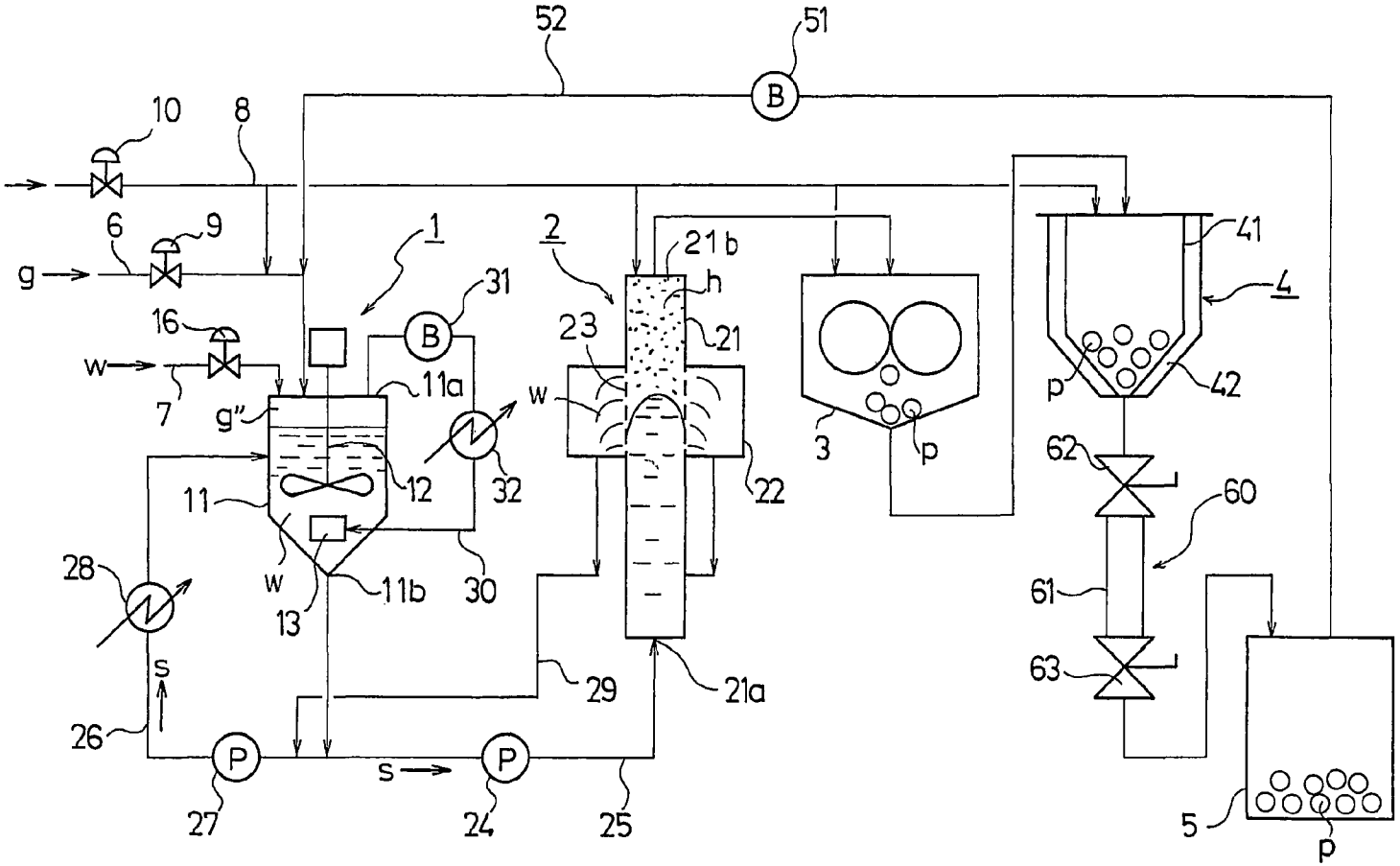
FIG. 2 shows rough structure of the second production facilities which conduct the method for producing mixed gas hydrate according to the present invention.

The difference between the first embodiment and the second embodiment is that the diluent gas m is supplied to the gas hydrate-forming apparatus 1, the dewatering tower 2, the high-pressure pelletizer 3, and the pellet cooler 4. As shown in FIG. 2, a first branch pipe 8*a* branched from the diluent gas supply pipe 8 is connected to the top part 21*b* of the dewatering tower 2, the high-pressure pelletizer 3, and the pellet cooler 4.

The above description explained the case that natural gas is used as the mixed gas. The mixed gas is, however, not limited to the natural gas, and other mixed gases of, for example, carbon dioxide and hydrogen can also be applied.

EXAMPLES

Examples for Comparison

In the step of forming gas hydrate, consideration was given on the speed until the gas-phase composition in the gas hydrate-forming apparatus reaches a steady state.

In concrete terms, an initial composition was established in the gas phase in the forming apparatus, and then the formation of gas hydrate is started to observe the changes of gas phase with the passage of time.

Two cases of the initial composition were established. Table 1 shows the initial gas-phase composition in each case.

(I) A composition the same as that of raw material gas (conventional starting method)

(II) The raw material gas diluted to a concentration of 26.3% using methane, or the raw material gas and the methane mixed at a rate of 1:2.8, (the dilution starting method according to the present invention)

Figure 3A:
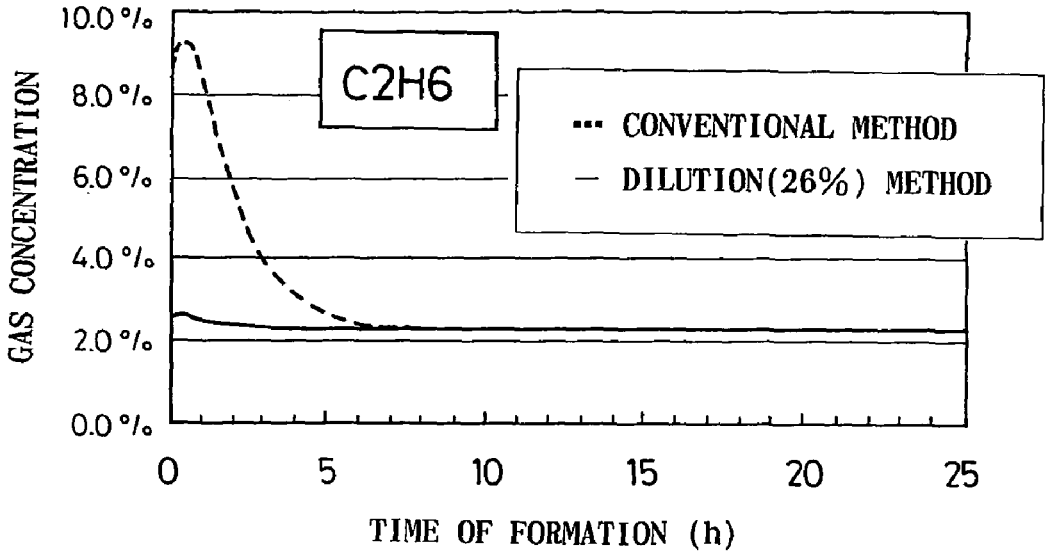
FIG. 3A is a graph showing the change with the passage of time for ethane.
Figure 3B:
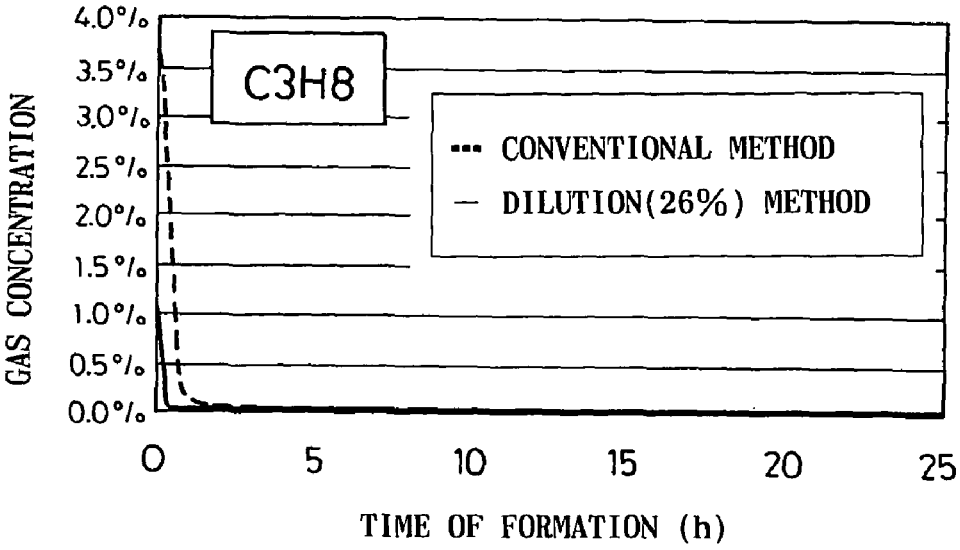
FIG. 3B is a graph showing the change with the passage of time for propane.
Figure 4A:
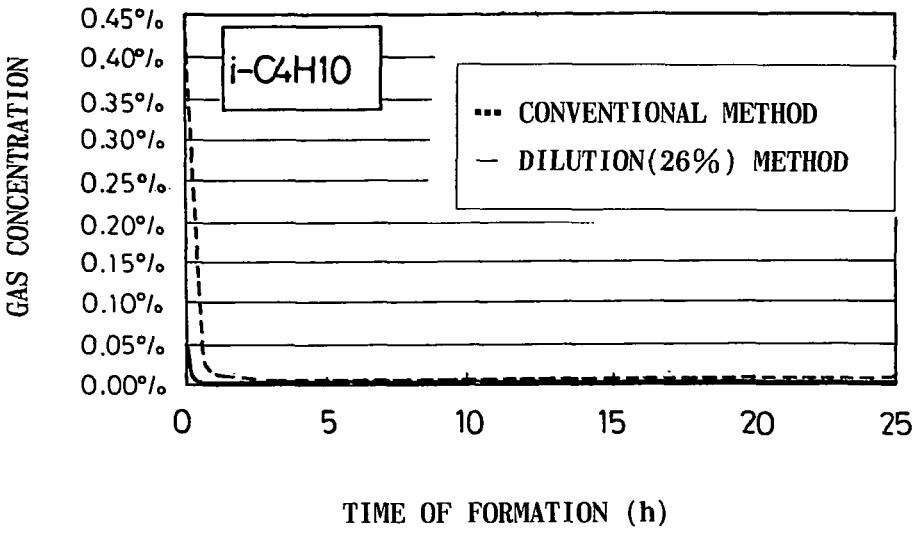
FIG. 4A is a graph showing the change with the passage of time for i-butane.
Figure 4B:
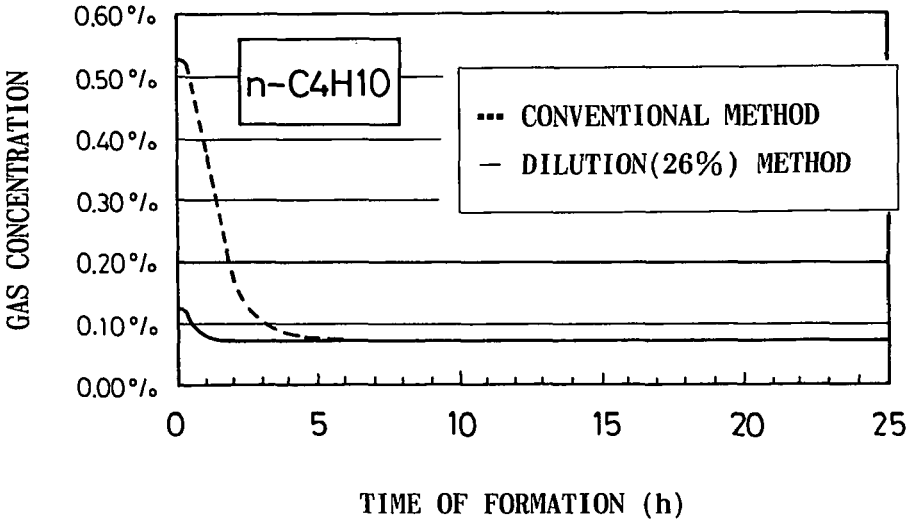
FIG. 4B is a graph showing the change with the passage of time for n-butane.
Figure 4C:
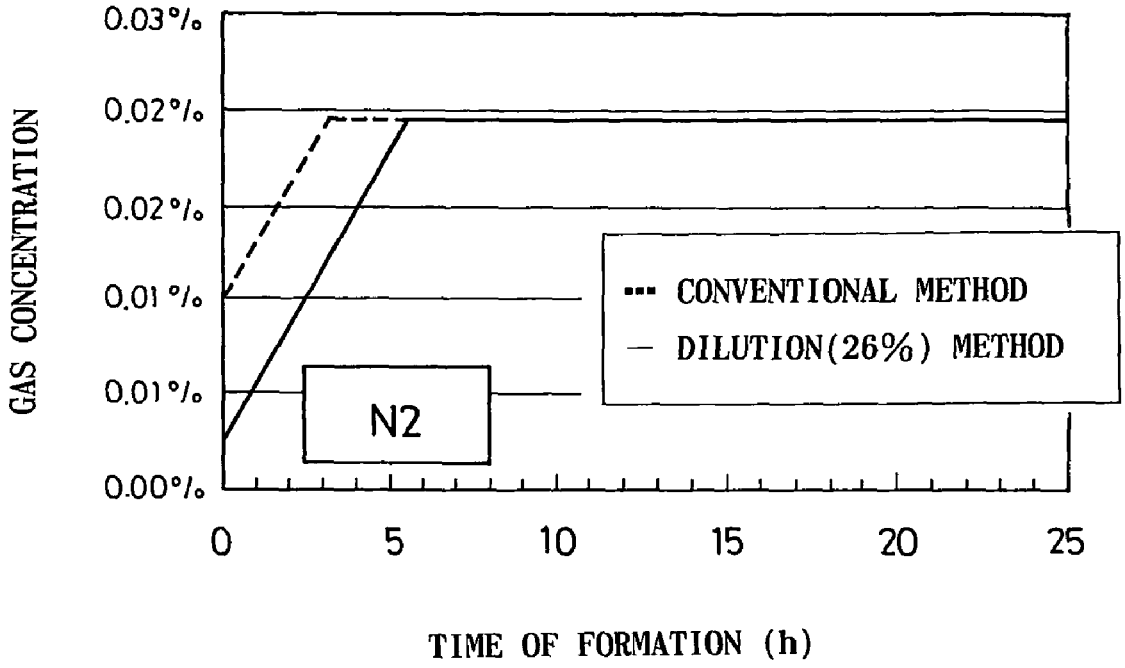
FIG. 4C is a graph showing the change with the passage of time for nitrogen.

The volume of the forming vessel was 22.8 L, and the water amount was 10 L. The result of the comparative consideration is shown in FIG. 3A, FIG. 3B, and FIGS. 4A to 4C. FIG. 3A shows the changes in the concentration of ethane, and FIG. 3B shows the changes in the concentration of propane. In addition, FIG. 4A shows the changes in the concentration of i-butane, FIG. 4B shows the changes in the concentration of n-butane, and FIG. 4C shows the changes in the concentration of nitrogen. For each figure, the initial concentration (I) is given by broken line, and the initial concentration (II) is given by solid line.

These figures derived the following findings. In the case of conventional starting method (I), for ethane, for example, the steady state was eventually reached about 6 hours after the beginning of formation. In the case of the dilution starting method (II) of the present invention, however, the steady state was reached in the early stage of about 3 hours after the beginning of formation.

TABLE 1

| Raw material gas composition | | Initial gas-phase composition (%) | |
|---|---|---|---|
| | | (I) Conventional starting up method | (II) Dilution starting up method |
| $CH_4$ | 86.73 | same to the left | 96.507 |
| $C_2H_6$ | 8.86 | same to the left | 2.33 |
| $C_3H_8$ | 3.47 | same to the left | 0.91 |
| i-$C_4H_{10}$ | 0.41 | same to the left | 0.11 |
| n-$C_4H_{10}$ | 0.52 | same to the left | 0.14 |
| $N_2$ | 0.01 | same to the left | 0.003 |

What is claimed is:

1. A method for producing mixed gas hydrate comprising the steps of:

(1) forming a gas hydrate in slurry form by the reaction between a mixed gas containing a principal component and at least one other component, and water;

(2) removing water from the gas hydrate in slurry form;

(3) pelletizing the gas hydrate after removing water therefrom to form pellets;

(4) freezing the gas hydrate in pellet shape by chilling to at or below the freezing point thereof; and (5) depressurizing the frozen gas hydrate to a storage pressure, wherein a diluent gas in the form of the principal component of the mixed gas is added to the mixed gas to be supplied to said step of forming the gas hydrate, and then the components of the mixed gas other than the principal component are diluted, and thus the mixed gas hydrate is produced by the diluted mixed gas.

2. A method for producing mixed gas hydrate comprising the steps of:

(1) forming a gas hydrate in slurry form by the reaction between a mixed gas containing a principal component and at least one other component, and water;

(2) removing water from the gas hydrate in slurry form;

(3) pelletizing the gas hydrate after removing water therefrom to form pellets;

(4) freezing the gas hydrate in pellet shape by chilling to at or below the freezing point thereof; and (5) depressurizing the frozen gas hydrate to a storage pressure, wherein a diluent gas in the form of the principal component of said mixed gas is preliminarily charged to said step of forming the gas hydrate, said step of removing water, said step of pelletizing the gas hydrate, and said step of freezing the gas hydrate.

3. The method for producing mixed gas hydrate according to claim 1, wherein the supply of the diluent gas is stopped 0 to 6 hours after the start of the formation of the gas hydrate.

4. The method for producing mixed gas hydrate according to claim 2, wherein the supply of the diluent gas is stopped 0 to 6 hours after the start of the formation of the gas hydrate.

* * * * *